US010392143B2

(12) United States Patent
Butturini

(10) Patent No.: US 10,392,143 B2
(45) Date of Patent: Aug. 27, 2019

(54) PERFECTED WINDING DEVICE

(71) Applicant: Luciano Butturini, Parabiago (IT)

(72) Inventor: Luciano Butturini, Parabiago (IT)

(73) Assignee: Italdibipack S.p.A., Pogliano Milanese (IT)

( * ) Notice: Subject to any disclaimer, the term of this patent is extended or adjusted under 35 U.S.C. 154(b) by 558 days.

(21) Appl. No.: 15/071,115

(22) Filed: Mar. 15, 2016

(65) Prior Publication Data

US 2016/0272350 A1 Sep. 22, 2016

(30) Foreign Application Priority Data

Mar. 19, 2015 (IT) ..... MI2015A0415

(51) Int. Cl.

| | |
|---|---|
| ***B65B 11/02*** | (2006.01) |
| ***B65B 45/00*** | (2006.01) |
| ***B65B 67/08*** | (2006.01) |
| *B66F 9/075* | (2006.01) |

(52) U.S. Cl.

CPC ..... *B65B 11/025* (2013.01); *B65B 45/00* (2013.01); *B65B 67/08* (2013.01); *B66F 9/07504* (2013.01)

(58) Field of Classification Search

CPC ..... B65B 11/02; B65B 11/025; B65B 11/045; B65B 11/008; B65B 11/58; B65B 11/585; B65B 45/00; B65B 67/08–10; B66F 9/07504

USPC ..... 53/399, 465, 210, 588; 414/490

See application file for complete search history.

(56) References Cited

U.S. PATENT DOCUMENTS

| | | | | |
|---|---|---|---|---|
| 4,282,700 | A | 8/1981 | Goldstein | |
| 4,369,614 | A | 1/1983 | Tetzner | |
| 5,184,449 | A * | 2/1993 | Hannen | B65B 11/025 53/176 |
| 5,195,301 | A * | 3/1993 | Martin-Cocher | B65B 11/045 53/441 |
| 5,344,277 | A * | 9/1994 | Sandland | B65B 13/02 410/97 |
| 5,447,008 | A * | 9/1995 | Martin-Cocher | B65B 11/025 53/399 |
| 5,463,842 | A * | 11/1995 | Lancaster | B65B 11/045 53/389.4 |
| 6,470,657 | B2 * | 10/2002 | Huson | B65B 67/08 53/390 |
| 6,557,869 | B2 * | 5/2003 | Gillette | B62B 1/12 280/47.28 |
| 6,644,907 | B1 | 11/2003 | Pinder | |
| 7,178,317 | B1 * | 2/2007 | Koskela | B65B 11/045 242/597.8 |

(Continued)

FOREIGN PATENT DOCUMENTS

| | | | | |
|---|---|---|---|---|
| EP | 1950134 A1 * | 7/2008 | | B65B 11/025 |
| EP | 2258652 A1 | 12/2010 | | |

(Continued)

*Primary Examiner* — Nathaniel C Chukwurah
*Assistant Examiner* — Joshua G Kotis
(74) *Attorney, Agent, or Firm* — Themis Law

(57) ABSTRACT

A winding device for loads includes a reel-holder roll adapted for receiving a reel of an extensible plastic film; a vertical column, along which the reel-holder roll is movable; and a lifting plane adapted to receive a load movable along the column, so that the winding device can be used as both a winder and a lifter for forming the load.

10 Claims, 11 Drawing Sheets

(56) References Cited

U.S. PATENT DOCUMENTS

| | | | | |
|---|---|---|---|---|
| 2003/0046908 | A1* | 3/2003 | Huson | B65B 11/025 53/588 |
| 2003/0093973 | A1* | 5/2003 | Mir | B65B 11/025 53/399 |
| 2005/0198922 | A1* | 9/2005 | Huson | B65B 11/025 53/399 |
| 2008/0209859 | A1 | 9/2008 | Venderheiden et al. | |
| 2012/0137636 | A1 | 6/2012 | Ours et al. | |

FOREIGN PATENT DOCUMENTS

| | | | | |
|---|---|---|---|---|
| EP | 2749498 | A1 | 7/2014 | |
| ES | 1138807 | U * | 4/2015 | B65B 11/025 |
| FR | 2361272 | A1 * | 3/1978 | B65B 13/02 |
| WO | WO0198152 | A2 | 12/2001 | |
| WO | WO2008091066 | A1 | 7/2008 | |

* cited by examiner

PERFECTED WINDING DEVICE

FIELD OF THE INVENTION

The present invention relates to a winding device, for example for pallets or the like.

BACKGROUND OF THE INVENTION

Winding a load, for example a load positioned on a pallet, by means of an extensible plastic film to unite the packages that form the load and also to protect the load is known in the art.

A particularly interesting situation is when the load is positioned on the pallet. In this situation the film engages both the load and the pallet simultaneously to enable a safe handling.

A known type of winding device relates to movable devices, both manual and automatic.

In short, these known devices comprise a column positioned on a ground base and a reel-holder roll that moves vertically along the column.

When a load of various packages must be formed or when a load must be wound on a pallet, the load must first be arranged on the same; this requires the use of a lifting apparatus (the height to be reached can in fact be considerable, even over two meters), with which the load is lifted (for example boxes or the like) and is arranged on the pallet.

When this step has been completed, a winding device of the known type is then used, which unwinds the extensible plastic film from a reel inserted on the reel-holder axis and winds it (manually or automatically) around the load and pallet. In order to allow a correct and sturdy winding, the reel-holder roll (with the axis parallel to the development in height of the column) slides upwards and vice versa along the column, so as to perform a plurality of turns of extensible film (each partially overlapping the previous one) around the combination of pallet and load.

A limitation already appears evident from the above description: the formation and winding of the load and pallet is relatively lengthy and requires the use of various devices, which must be free and available in the warehouse.

It should be considered, in fact, that the time required for preparing and winding a load, for example on a pallet, must be as short as possible, to avoid creating additional costs and also to rapidly prepare the goods for delivery.

With specific reference to the winding devices that are known in the art, in manual devices, the column is positioned on a stand with wheels, preferably swivel wheels, which is rotated around the load (and possibly also the pallet) for winding. Although altogether practical and relatively economical, these systems have the drawback of having an extremely reduced versatility of use, as they can only be used for the above indicated specific purpose.

As far as automatic devices are concerned, on the other hand, the column is rotatable with respect to the base, rotatably supported by a second column, fixed with respect to the base; in this case, in addition to the limitations common with manual winding devices, the cost and encumbrance are not only much higher, but there are also limitations associated with the engagement height of the plastic film on the pallet. For geometric reasons, in fact, only a small part of the pallet is wound by the plastic film, with the result that the unification between the pallet and load does not always have a satisfactory robustness.

SUMMARY OF THE INVENTION

The general objective of the present invention is, therefore, to provide a winding device which is capable of overcoming these drawbacks.

A further objective of the invention is to provide a winding device and lifter in a single machine.

The above objectives are achieved by a winding device according to the invention, which may include optional featured described hereinafter.

A basic idea in the invention is to provide a winding device for loads comprising a reel-holder roll configured to receive a reel of an extensible plastic film, and a vertical column along which the roll can be moved (upwards and downwards in an operational condition of the device). A device according to the invention also comprises a lifting plane adapted for receiving a load, the plane being movable along the column, so that the device can be used as both a winder and a lifter for forming the load.

In this way, a device is obtained which provides considerable savings in terms of space, as it combines the advantages of both a winder and a lifter.

In addition to space, not only are the overall costs reduced, but also the time necessary for forming a load, as the operator can use a single device according to the invention for this purpose.

Other advantages also relate to the safety, because, compared with known automated devices, a device according to the invention does not have a movable arm.

According to optional advantageous features, a device according to the invention can not only be activated manually (assembled on a trolley with wheels, preferably swivel wheels) but can also be moved by a transpallet or similar motorized operator trolleys.

A further advantage of a device according to the invention lies in the fact that the reel-holder roll can be lowered to allow a considerable portion of the pallet (if this is used) to be engaged with the plastic film, thus obtaining an extremely robust unification of load and pallet.

BRIEF DESCRIPTION OF THE DRAWINGS

The structural and functional features of the invention, and its advantages with respect to the known art will appear clearly evident from the following description, referring to the enclosed drawings, which show various possible embodiments of the device produced according to the innovative principles of the invention.

In the drawings.

Figure 11:
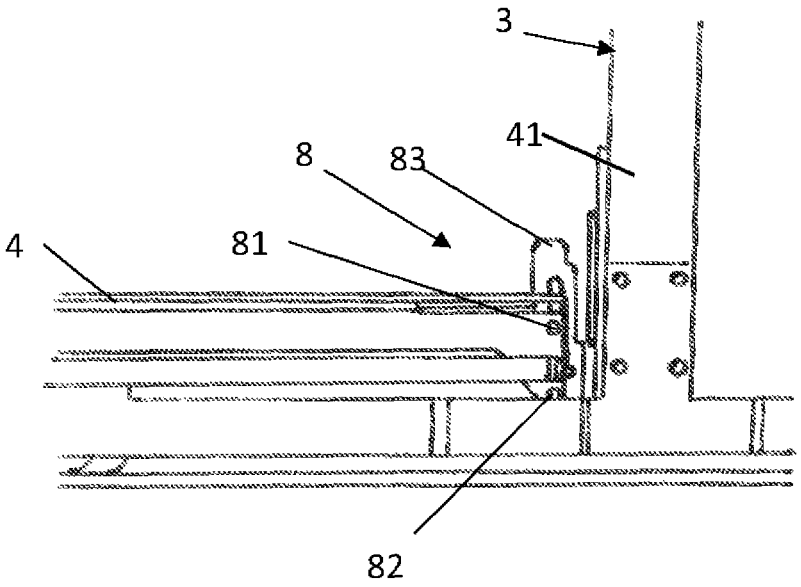
Figure 12:
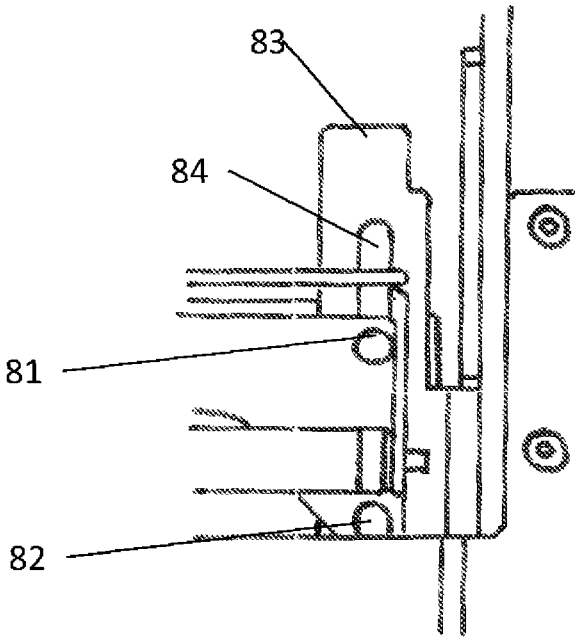
Figure 13:
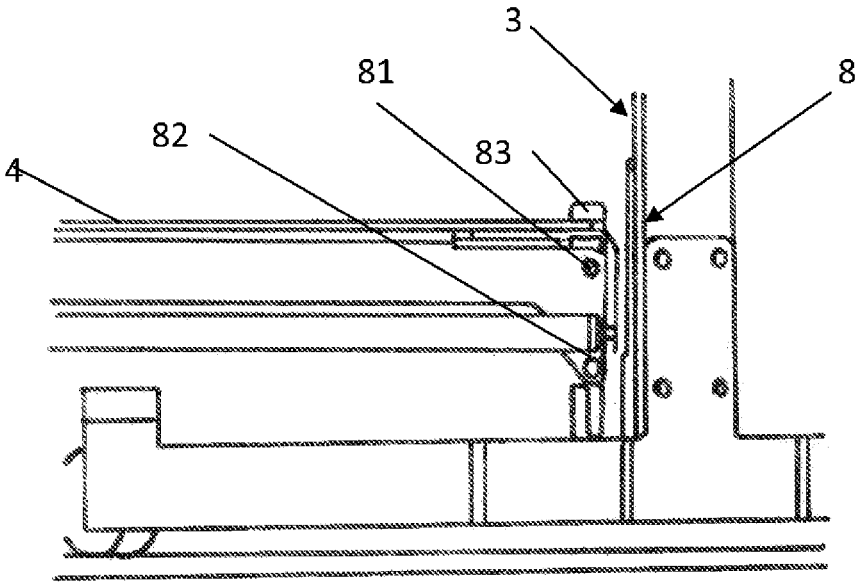
Figure 14:
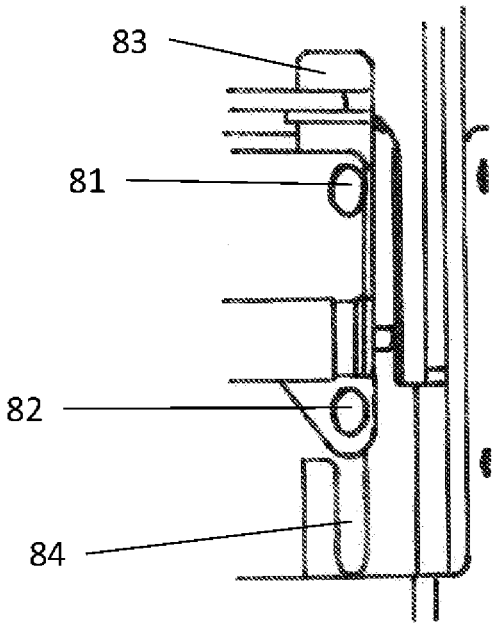
Figure 15:
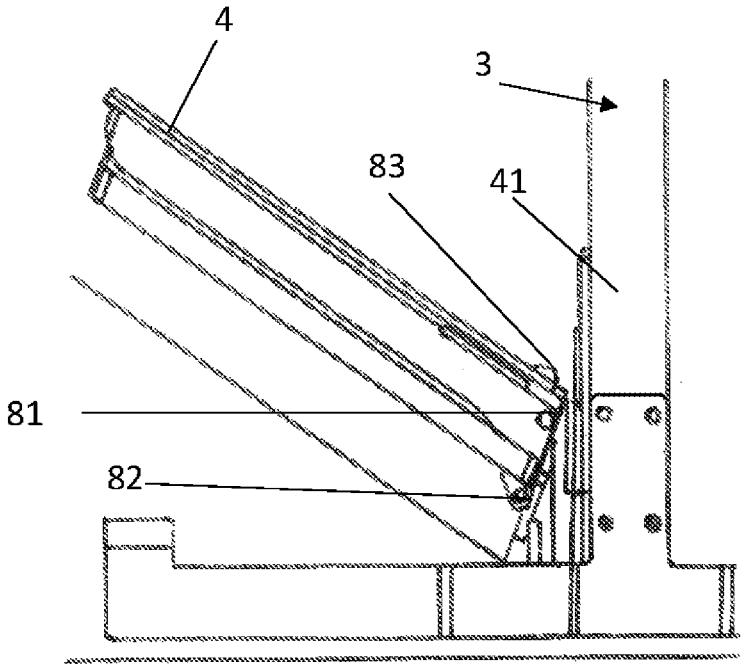
Figure 16:
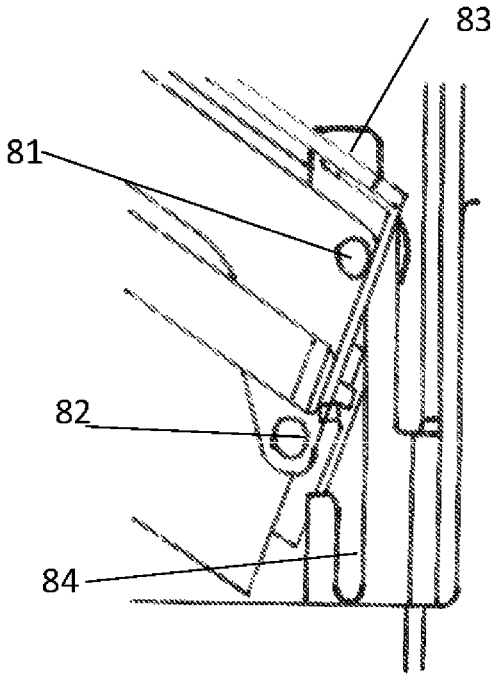
Figure 17:
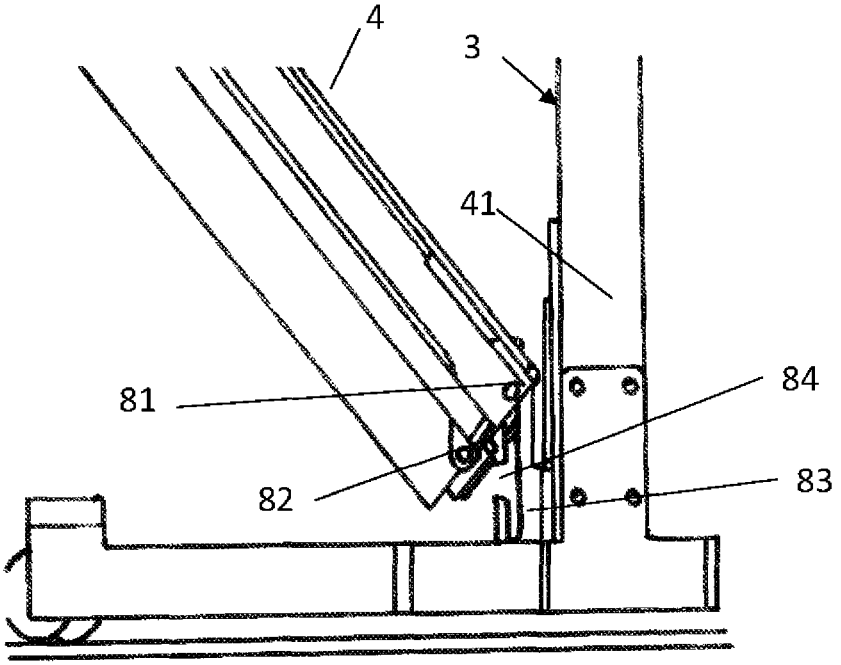
Figure 18:
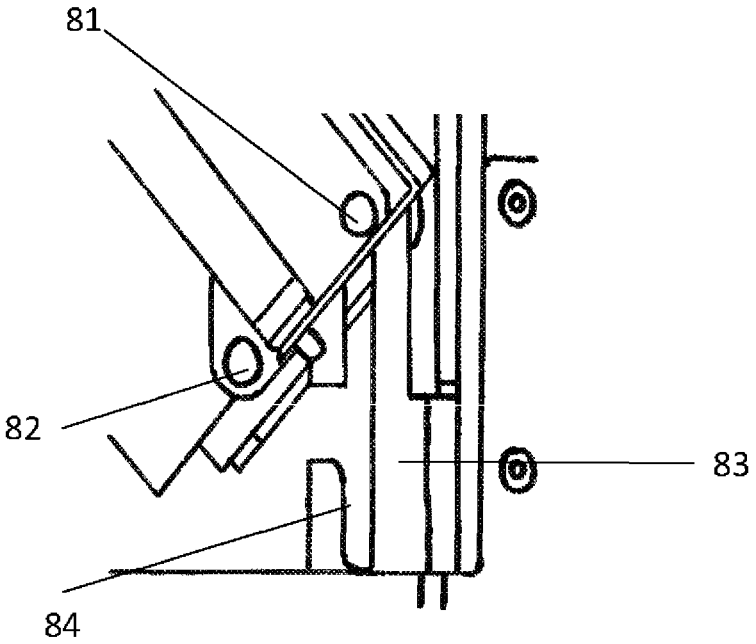
Figure 19:
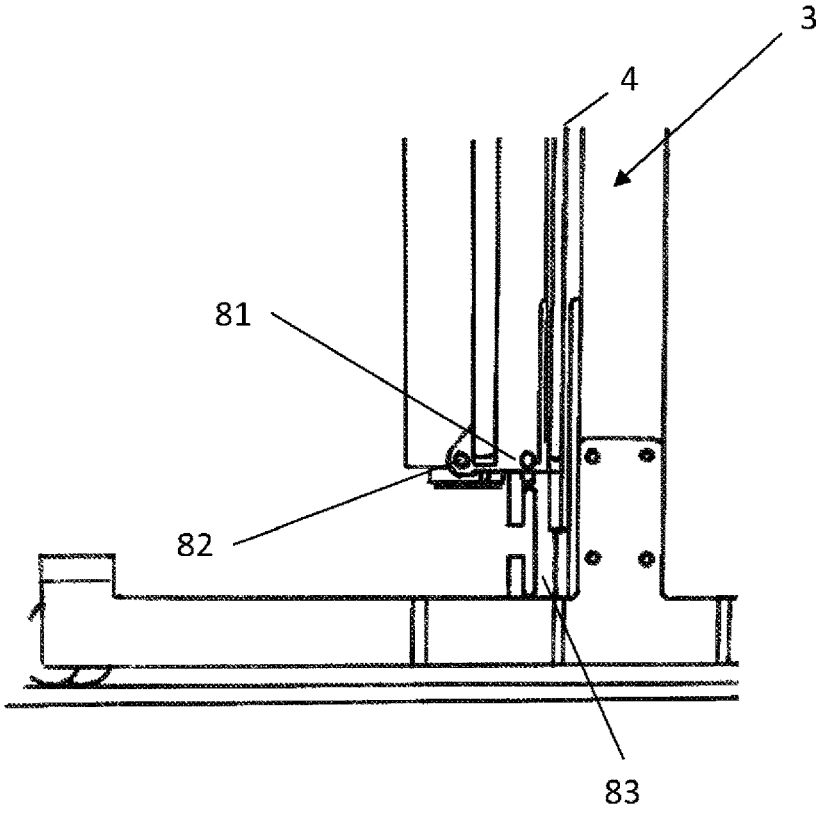
Figure 20:
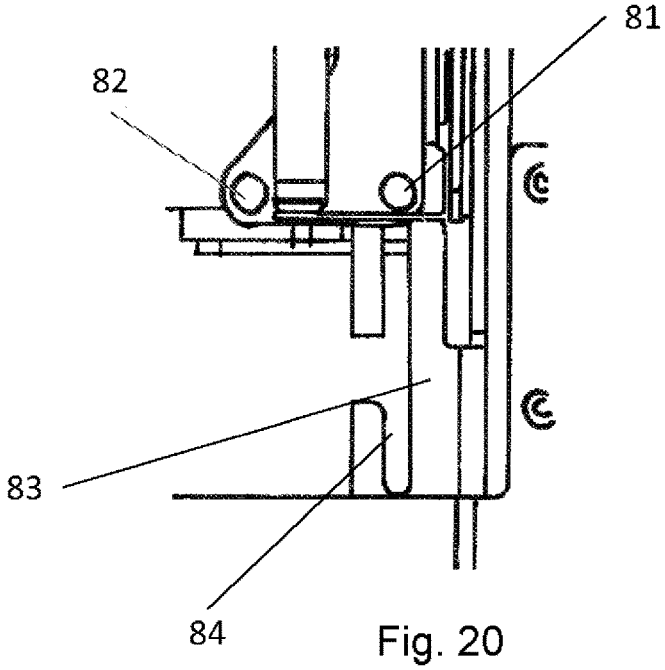
Figure 23:
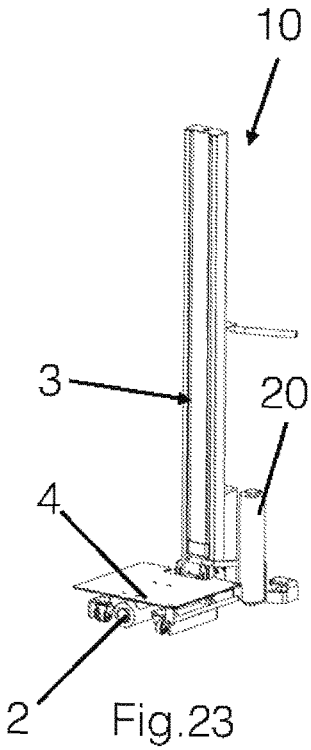
Figure 24:
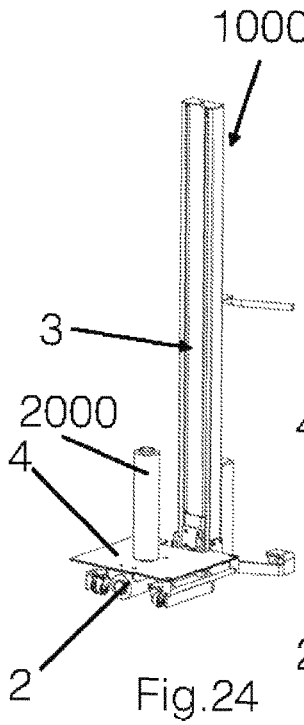
Figure 25:
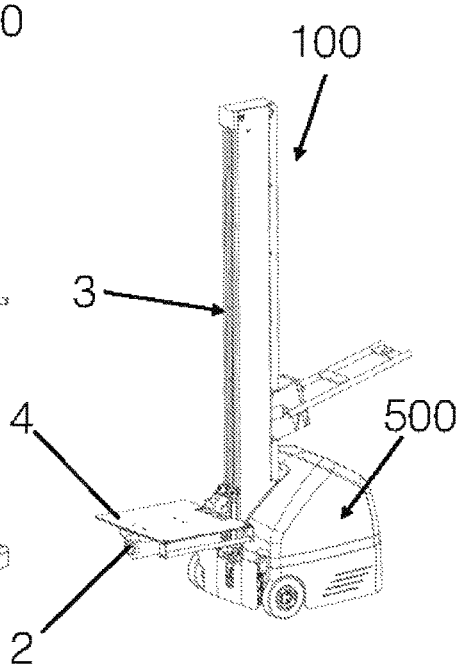

the pairs of FIGS. 11, 12; 13, 14; 15, 16; 17, 18; and 19, 20 and 21, 22 respectively show (for each pair) a detail of the hinge and an enlarged detail thereof in various passage times from the lifting position to the winding position;

FIGS. 23, 24 and 25 show three devices according to the invention.

DETAILED DESCRIPTION OF EMBODIMENTS OF THE INVENTION

Possible references to directions or positions (vertical/horizontal, up/down and the like) should be considered in the present description and claims as referring to the device in an operating condition and with the meaning normally attributed to these terms in everyday language.

With reference to the enclosed FIGS. 1-22, there is shown a first basic embodiment of a winding device 1 according to the invention.

The winding device 1 illustrated therein comprises a reel-holder roll 2 adapted for receiving a reel of an extensible plastic film F, of a type known in the art.

The device 1 also comprises a vertical column 3, which, in an operating condition, is substantially in a normal position with respect to the rest plane of the device, directed vertically.

As can be seen in the figures, the roll 2 can be moved along the column 3, upwards and downwards, so as to bring the reel of plastic film to different heights and enable the winding of the load with a plurality of partially overlapping turns of film.

Figure 6:
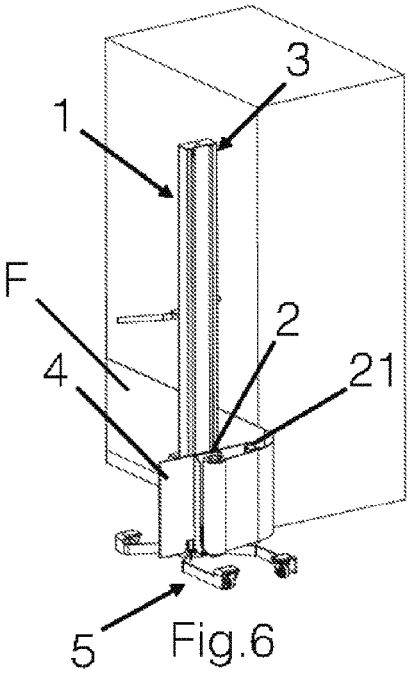
FIG. 6 shows an example of use of the device of FIGS. 1-3 during the winding of a load.
Figure 7:
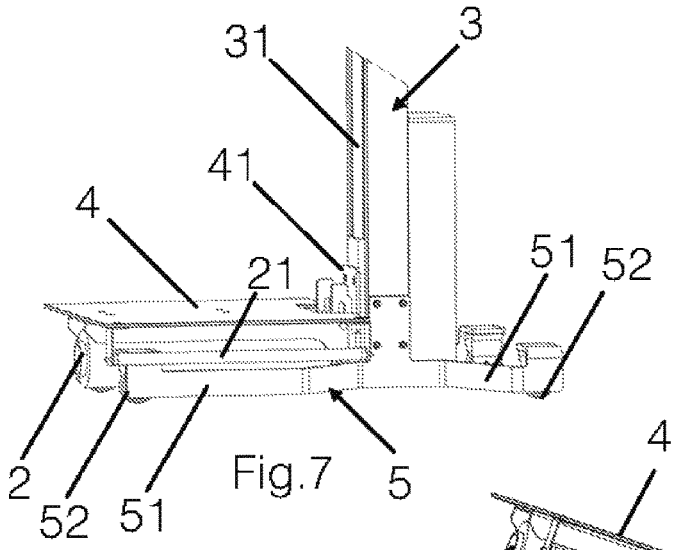
FIGS. 7-10 show a detail of the device of FIGS. 1-3 illustrated in the same number of passage times from the lifting position to the winding position.
Figure 8:
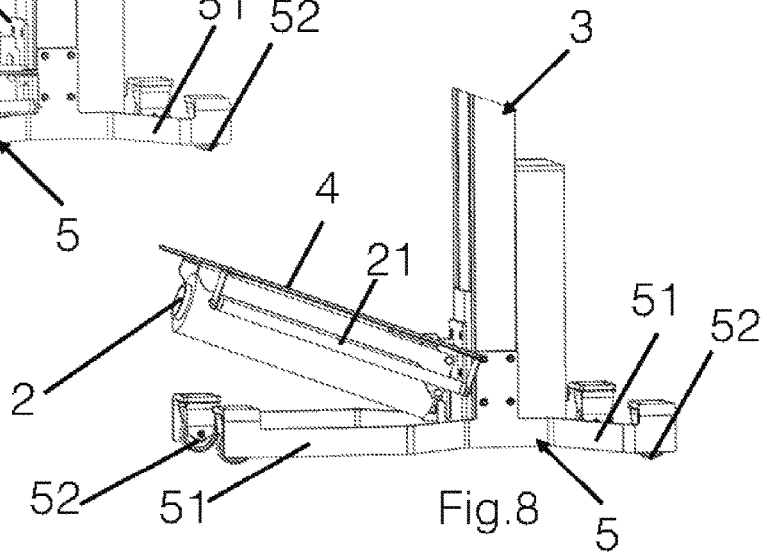
Figure 9:
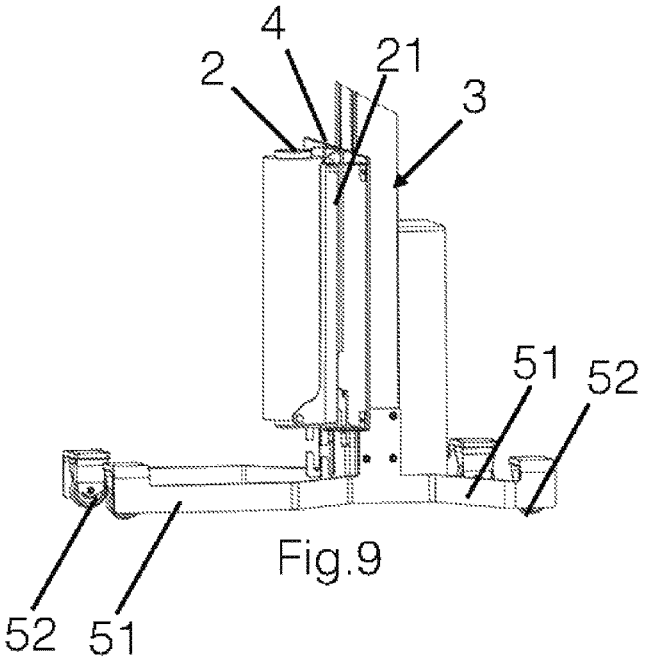
Figure 10:
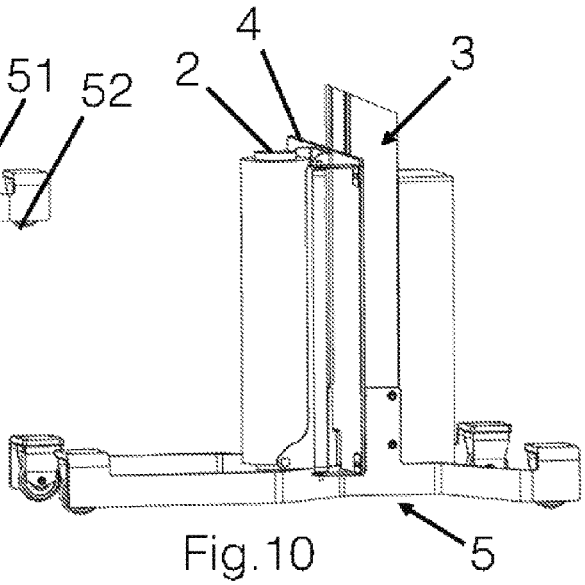

Said winding is performed by moving the device 1 around the load, which is stationary, as shown in FIG. 6.

Figure 1:
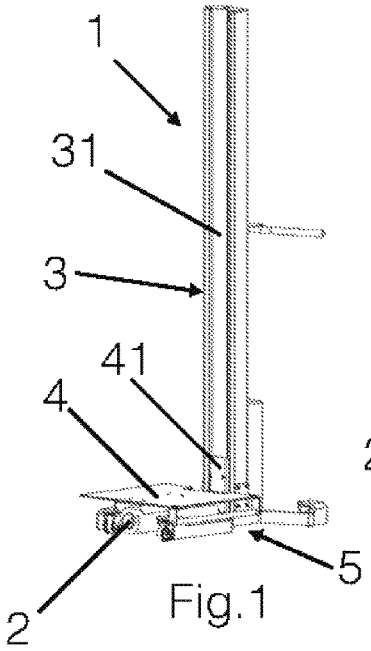
FIGS. 1, 2 and 3 show a first embodiment of a winding device according the invention in three positions, lifting, passage and winding, respectively.
Figure 2:
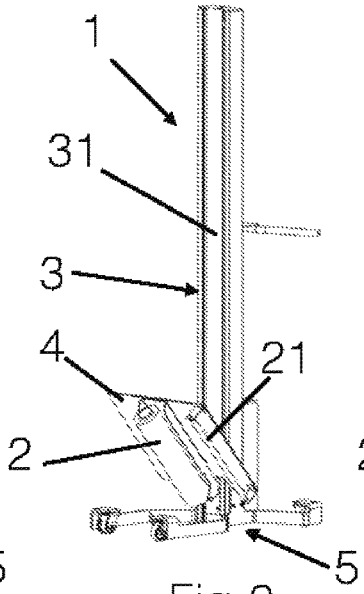
Figure 3:
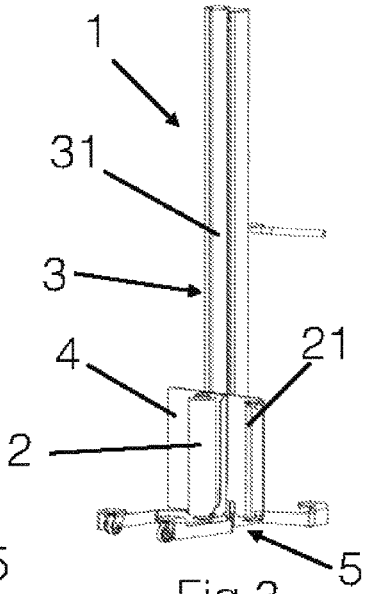
Figure 4:
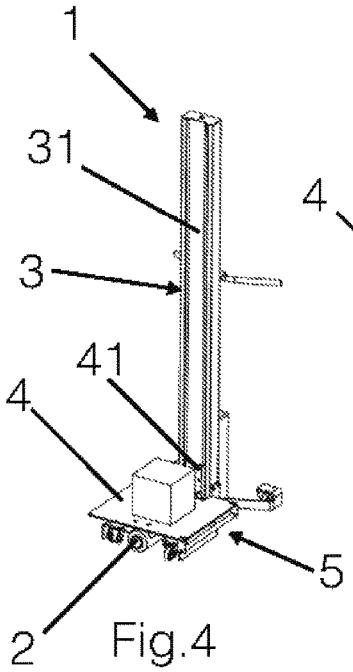
FIGS. 4 and 5 show two examples of use of the device of FIGS. 1-3 during the lifting of a load.
Figure 5:
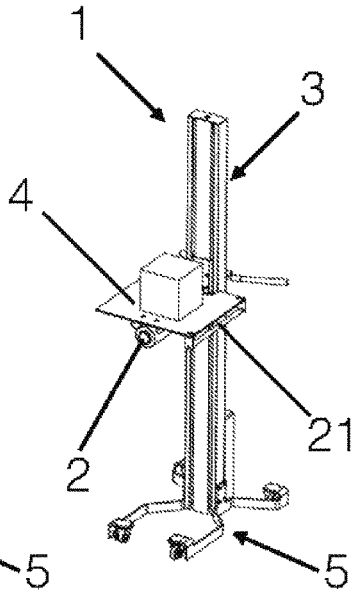

According to the invention, the device 1 comprises a lifting plane 4 suitable for receiving a load, for example a box or the like, as shown in FIGS. 4 and 5.

The load which receives the plane 4 can be part of the load which is formed, for example, on a pallet.

The lifting plane 4 can be moved along the column 3, upwards and downwards, so that said device 1 can be advantageously used as both a winder and a lifter for forming the load; a lifting phase is shown in FIGS. 4 and 5.

The plane 4 can preferably be moved substantially along the entire extension of the column 3. For this purpose, the column 3 comprises a sliding guide 31, preferably "C"-shaped, in which a sliding cursor 41 is engaged, coupled with the plane 4.

The cursor 41 is preferably a trolley with wheels, which moves in the guide 31 activated by means of an activation mechanism, manual or motorized as the case may be, provided, for example, in the first case with an activation lever and suitable mechanical transmission devices (belts, chains, toothed wheels and the like). If the activation mechanism of the trolley is motorized, it comprises a motor, for example an electric motor and suitable mechanical transmission devices (belts, chains, toothed wheels and the like).

The guide 31, if present, preferably extends for substantially the entire length of the column 3.

In the basic embodiment of FIGS. 1-22, the roll 2 is coupled with the lifting plane 4 and moves integrally with it along the column 3 due to the above guide.

In particular, the roll 2 is not directly coupled with the column 3, but is indirectly coupled specifically by reason of the plane 4 and its cursor 41.

In this embodiment, moreover, the roll 2 and the plane 4 are rotatably coupled with the column 3. In principle, the "rotatable" coupling does not exclude that the rotation (revolving) be formed with other movement trajectories, for example a straight translation (or sliding), as explained hereunder.

In the case of a revolving coupling, at least one rotation pin 81 is provided, which articulates the plane 4 with the column 3. As the case may be, the pin can be fixed (to perform only a pure rotation) or it can in turn be moved (like the pin 81 referred to hereunder) to obtain the formation of trajectories (for obtaining, for example, a roto-translation).

The roll 2 and the plane 4 can be moved between a first lifting position, in which the plane 4 is substantially orthogonal to the column 3, as in FIGS. 1, 4, 5, 7, 11, 12, and a second winding position of the load, in which the plane 4 is parallel to the column 3, as in FIGS. 3, 6, 10, 21, 22. The passage between the lifting position and the winding position—and vice versa—takes place by means of a passage in intermediate positions, variably shown in FIGS. 2, 8, 9, 13, 14, 15, 16, 17, 18, 19, 20.

It is optionally envisaged that the coupling between the plane 4 (and therefore the roll 2 integral therewith) and the column be a roto-translation coupling, wherein, in practice, the plane 4 not only rotates, but also slides with respect to the cursor or trolley 41, which in turn slides with respect to the column 3.

For this purpose, a roto-translation joint 8 is envisaged, which is configured for coupling with the trolley 41 and the plane 4.

The joint 8, which can be seen in detail in FIGS. 11-22 in various positions, comprises a roto-translation guide 83 integral with the trolley 41 and two pins 81, 82 integral with the plane 4.

The roto-translation guide 83 has at least one open neck 84, in which the two pins 81, 82 are free to move. Such open neck 84 has the form of a "T" rotated by 90°, whereas the pins 81, 82 are positioned aligned and spaced on a plane perpendicular to that on which the loading plane 4 develops.

The roto-translation guide 83 enables the disengagement of one of the two pins 82 to bring the plane 4 in a winding position, parallel to the column 3.

Figure 21:
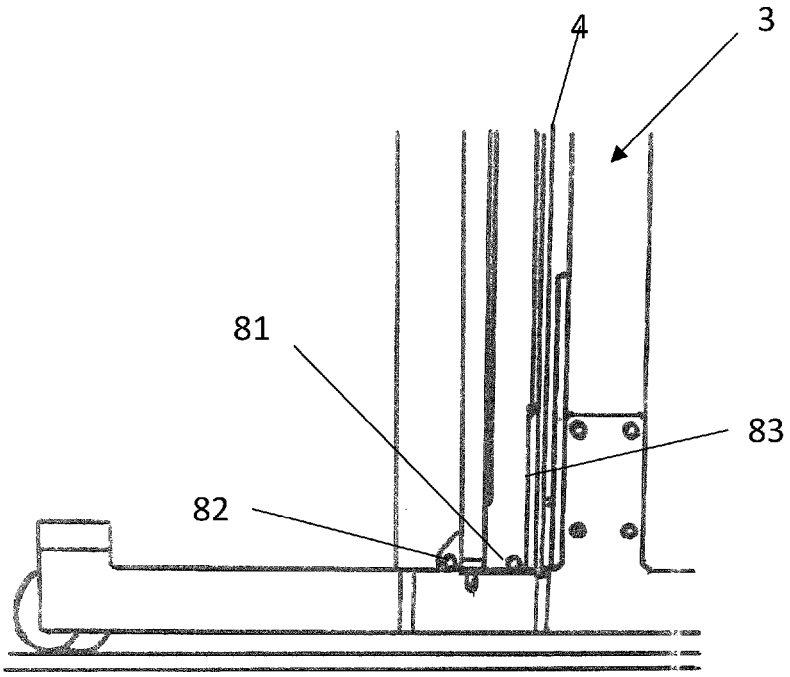
Figure 22:
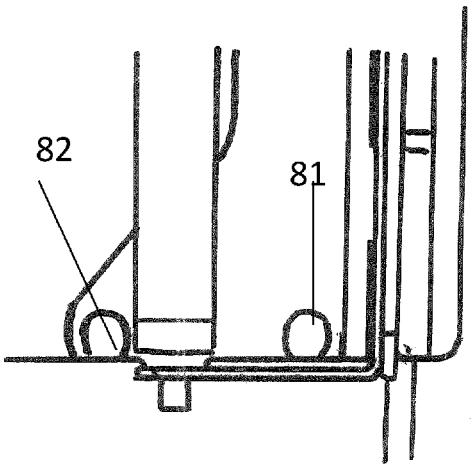

In particular, starting from FIGS. 11, 12 and continuing up to FIGS. 21, 22, it can be noted that:

in the lifting position, the plane 4 is perpendicular to the column (FIGS. 11, 12), and both pins 81, 82 are engaged in the open neck 84 of the roto-translation guide 83, so that the plane 4 is firmly in a substantially horizontal position;

in a first step (FIGS. 13, 14), the plane 4 is lifted with respect to the roto-translation guide 83, so that the lower pin 82 is in front of the opening of the open neck 84;

in a second step (FIGS. 15, 16), the plane 4 rotates around the pin 81 engaged in the shaped guide 83 so as to disengage the second pin 82 from the open neck 84;

in a third step (FIGS. 17, 18), the rotation of the plane 4 toward the column 3 continues around the first pin 81, not hindered by the second pin 82, free from the open neck 84;

in a fourth step (FIGS. 19, 20), the plane 4 is parallel to the column 3 and the pin 81 is in correspondence with the upper end of the open neck 84;

finally, in order to reach the winding position (FIGS. 21, 22), the plane 4 slides towards the base, until the first pin 81 reaches the opposite end (lower) of the open neck 84.

It should be noted that these operations are performed with the trolley 41 stationary with respect to the column 3.

The plane 4 is then blocked thanks to blocking means in this position.

The blocking in position is achieved, for example, due to the resting of the edge of the plane on the stand 5. This way, the very weight of the plane 4 and roll 2 keeps the plane 4 stably resting on the stand 5, thus enabling the winding operation.

According to an optional feature, an unwinding roll 21 may be provided in parallel position to the reel-holder roll 2, which can be used in the winding operations for keeping the film F in a correct position and preventing creases.

In some variants, the unwinding roll 21 is replaced by a pre-stretching device of the extensible plastic film. Said pre-stretching devices are known in the state of the art and consequently no further reference will be made thereto.

It should be noted that the feature of having the plane 4 (and therefore the roll 2 integral therewith) that is movable by means of roto-translation with respect to the cursor or trolley 41, not only allows the roll 2 to be brought (by rotation) in an operative position (parallel to the column), but also the edge of the film wound onto the reel held by the roll 2 to be lowered to a height close to the stand 5. This way—by basically lowering the edge of the film F toward the ground—the film F can be wound around the load starting from a minimum height very close to the ground. If a pallet holding a load is to be enveloped, a significant part of the same pallet can therefore be wound with the film, advantageously providing not only a high robustness of the winding but also unifying the load and pallet.

The roll 2 is advantageously positioned, in an operative condition of the device 1, with reference to the first position, below the plane 4.

In particular, in this embodiment, with reference to the lifting position, the longitudinal axis of the roll 2 develops perpendicular to the vertical axis of the column 3 and passes through the center of gravity of the plane 4.

This allows the reel of plastic film to be housed in a central position, also reducing the amplitude of the stand (or trolley) 5.

During winding, in fact, a considerable pulling force is generated which, together with the weight of the reel of film, enables a possible, but less advantageous, eccentric positioning as in the second embodiment 10 of FIG. 23.

In this latter case, in fact, in order to prevent the device from overturning, a larger stand is required, contrary to the requirement of having a compact device 1, which must typically be rotated around the load (and/or pallet) and which should, therefore, ideally have as small a stand as possible in order to be more manageable.

As far as the stand 5 is concerned, in this embodiment, the stand 5 comprises arms 51 carrying wheels, preferably swivel wheels 52.

The stand 5 is coupled with the column 4 by means of a coupling frame.

Other forms of stands are possible, however, for example a plate with wheels or the like.

Alternatively, in other embodiments of the device 10 and 100, the device can be activated manually, analogously to the above described device 1, but specifically have the reel-holder roll 20, 2000 in a different position with respect to the previously described preferred embodiment 1.

In the embodiment 10 of FIG. 23, for example, the roll 20 slides with respect to the column but in a fixed position with respect to the plane 4. For this purpose, the roll 20 is coupled with the cursor or trolley 41 of the above described type, In this basic embodiment, which is easier to implement, the stand can be wider than the stand of the embodiment 1, for the above described reasons.

A roll 2 as previously described can be provided in combination therewith.

Furthermore, in this embodiment, in the absence of the roll 2, the plane 4 may not be overturned with respect to the column 3.

In the embodiment 1000 of FIG. 24, on the other hand, the reel-holder roll 2000 is coupled with the plane 4.

The above described roll 2 may also be provided in combination therewith, to have a greater versatility (e.g. possibly housing two reels of different films).

The roll 2 in the embodiment 1000 can also not be provided. In this case, the rotation of the plane 4 with respect to the column 3 can be prevented (the plane 4 only slides along the column 3, but it does not rotate), as this is substantially of little use.

In this embodiment, the plane 4 is provided with engagement means for the roll 2000, preferably positioned in correspondence with the center of gravity of the plane 4 and on its upper surface.

When the load has been completely formed, the operator can then insert the roll 2000 and therefore the reel of film F on the plane 4 and start the winding operation.

Again, in a different embodiment 100 shown in FIG. 25, the stand 500 is motorized and comprises an electric motor, driving wheels, a steering system, and a guiding system.

In other embodiments, the stand is a transpallet.

The protection scope of the invention is defined by the following claims.

The invention claimed is:

1. A winding device (1,10,100,1000) adapted to wrap a load with an extensible plastic film, comprising:

a reel-holder roll (2) adapted to receive a reel of the extensible plastic film;

a vertical column (3), the roll (2) being movable along the column (3); and a lifting plane (4) adapted to support the load, the lifting plane (4) being movable along the column (3), wherein the column (3) comprises a sliding cavity (31) which extends along the column, a sliding cursor (41) being engaged in the sliding cavity (31) and coupled to the lifting plane (4), and wherein the roll (2) and the lifting plane (4) are joined to one another and rotatably coupled with the column (3) and movable between a first lifting position for lifting the load, in which the lifting plane (4) is substantially orthogonal to the column (3), and a second winding position for winding the load, in which the lifting plane (4) is parallel to the column (3).

2. The winding device (1,10,100,1000) according to claim 1, wherein the column (3) guides the sliding cursor (41).

3. The winding device (1,10) according to claim 1, wherein at least the lifting plane (4) is coupled to the sliding cursor (41) by a roto-translation coupling (8) comprising a roto-translation joint (8) that couples the cursor (41) with the lifting plane (4).

4. The winding device (1,10,100,1000) according to claim 3, wherein the roto-translation joint (8) comprises a roto-translation guide (83) integral with the sliding cursor (41) and two pins (81,82) integral with the lifting plane (4).

5. The winding device (1,10,100,1000) according to claim 1, wherein the roll (2) is positioned, in an operative condition of the winding device (1,10,100,1000), in the first lifting position, below the lifting plane (4), a longitudinal development axis of the roll lying on a plane substantially parallel to the lifting plane (4).

6. The winding device (10) according to claim 1, wherein another reel-holder roll (20) extends parallel to the column (3).

7. The winding device (10) according to claim 1, further comprising a pre-stretching device of the extensible plastic film.

8. The winding device (1,10,100,1000) according claim 1, further comprising a stand (5) for resting on a ground, the stand being equipped with wheels.

9. The winding device (100) according to claim 1, further comprising a motorized supporting stand (5) comprising an electric motor, driving wheels, a steering system, and a guiding system.

10. A winding device (1,10,100,1000) adapted to wrap a load with an extensible plastic film, comprising:

a reel-holder roll (2) adapted to receive a reel of the extensible plastic film;

a vertical column (3), the roll (2) being movable along the column (3); and a lifting plane (4) adapted to support the load, the lifting plane (4) being movable along the column (3), wherein the column (3) comprises a guide (31) which extends along the column, a sliding cursor (41) being engaged in the guide (31) and coupled to the lifting plane (4), and wherein the roll (2) and the lifting plane (4) are rotatably coupled with the column (3) and movable between a first lifting position for lifting the load, in which the lifting plane (4) is substantially orthogonal to the column (3), and a second winding position for winding the load, in which the lifting plane (4) is parallel to the column (3), wherein at least the lifting plane (4) is coupled to the sliding cursor (41) by a roto-translation coupling (8) comprising a roto-translation joint (8) that couples the cursor (41) with the lifting plane (4), wherein the roto-translation joint (8) comprises a roto-translation guide (83) integral with the sliding cursor (41) and two pins (81,82) integral with the lifting plane (4), wherein the roto-translation guide (83) has at least one open neck (84) configured to enable the two pins (81,82) to move freely therein, the pins (81,82) being aligned with each other and spaced on a plane perpendicular to a development plane of the lifting plane (4), thereby enabling a disengagement of at least one of the two pins (82) during passage from the first lifting position to the second winding position.

* * * * *